US008790422B2

(12) United States Patent
Cracknell et al.

(10) Patent No.: US 8,790,422 B2
(45) Date of Patent: Jul. 29, 2014

(54) FUEL FORMULATIONS

(75) Inventors: Roger Francis Cracknell, Chester (GB); Trevor James Davies, Chester (GB); Gautam Tavanappa Kalghatgi, Chester (GB)

(73) Assignee: Shell Oil Company, Houston, TX (US)

( * ) Notice: Subject to any disclaimer, the term of this patent is extended or adjusted under 35 U.S.C. 154(b) by 240 days.

(21) Appl. No.: 13/104,403

(22) Filed: May 10, 2011

(65) Prior Publication Data

US 2011/0271926 A1 Nov. 10, 2011

(30) Foreign Application Priority Data

May 10, 2010 (EP) ..... 10162373

(51) Int. Cl.
*C10L 1/10* (2006.01)

(52) U.S. Cl.
USPC ..... 44/300; 585/14

(58) Field of Classification Search
USPC ..... 44/300; 585/14
See application file for complete search history.

(56) References Cited

U.S. PATENT DOCUMENTS

| | | | | |
|---|---|---|---|---|
| 5,855,629 | A | 1/1999 | Grundy et al. | 44/400 |
| 2005/0000855 | A1* | 1/2005 | Farrell et al. | 208/16 |

FOREIGN PATENT DOCUMENTS

| | | | |
|---|---|---|---|
| RU | 2369868 | 10/2009 | G10N 33/22 |

OTHER PUBLICATIONS

PCT International Search Report dated Aug. 4, 2011, Application No. PCT/EP2011/057476 filed May 10, 2011.
Mantz, P.W. et al., "Pre-Ignition in Highly Turbo-Charged Engines: Analysis Procedure and Results", 8th International Symposium on Internal Combustion Diagnosis, Baden-Baden, 2008.
Zadeth, A., et al., "Diagnosing Engine Combustion Using High-Speed Photograohy in Conjunction with CFD", 8th International Symposium on Internal Combustion Diagnosis, Baden-Baden, 2008.
Han, K.M., et al., "3-D Visualization of Spark-Ignition Combustion: Practical Examples of Flame Propagation, Abnormal Combustion and Controlled Compression", 8th International Symposium on Combustion Diagnostics, Jun. 2008, Kurhaus Baden-Baden, Germany.
Gerringer, B. et al., "Comparision of the Phenomena of Auto Ignition in Highly Charged Si Engines With External and Internal Mixture Formation Regarding Influencing Variables, Mechanisms and Preventive Measures", Viena University of Technology, Austria.
Davis, S.G., et al., "Laminar Flame Speeds and Oxidation Kinetics of Benzene of Benzene-Air and Toluene-Air Flames", Department of Mechanical and Aerosspace Engineering, Princeton University, Princeton USA, 1996, pp. 1025-1033.
Davis, S.G. et al., "Laminar Flame Speeds and Oxidation Kinetics of *iso*-Octane-Air and *n*-Heptane-Air Flames", Department of Mechinical and Aerospace Engineering, Princeton University, Princeton USA,1998, pp. 521-527.
Metghalchi, M., et al., "Burning Velocities of Mixtures of Air With Methonol, Isooctane, and Indolene at High Pressure and Temperature", Combusiton and Flame, 1982, vol. 48, pp. 191-210.
Johnston, R. J. et al., "Laminar Burning Velocities and Markstein Lengths of Aromatics at Elevated Temperature and Pressure", Science Direct, Proceeding of the Combustion Institute, vol. 30, 2005, pp. 217-224.
Kalghatgi, G.T. et al., "The Nature of 'Superknock' and its Origins in SI Engine", Shell Global Solutions, UK, Shell Research Ltd, 2009, pp. 259-169.
Lewis, B., et al., Combustion, Flames and Explosions of Gases, 2nd Ed., Academic Press Inc., NY & London, 1961, Ch. 5.
Kurdyumov, V., et al., "On the Calculation of the Minimum Ignition Energy", Combustion & Flame, 2004, vol., pp. 394-397.
Metghalchi, M., et al., "Laminar Burning Velocity of Propane-Air Mixtures at High Temperature and Pressure", Combustion and Flame, 1980, vol. 38, pp. 143-154.
Stanglmaier, R.H., et al., "Measurement of Laminar Burning Velocity of Multi-Component Fuel Blends for Use in High-Performance SI Engines", SAE Technical Paper Series, SAE International, Powertrain & Fluid Systems Conference & Exhibition, Pittsburgh, PA, USA, Oct. 2003.
EPO, extended European Search Report, Application No. 10162373.4-2104, dated Oct. 29, 2010.

* cited by examiner

*Primary Examiner* — Cephia D Toomer

(57) ABSTRACT

Gasoline fuel formulation having a laminar burning velocity $S_L$ which is equal to or below that of isooctane at a pressure of 1 bar, a temperature of 300 K and stoichiometric air/fuel mixture strength. The formulation can be used to reduce pre-ignition in a turbocharged spark ignition engine, in particular when operating with an inlet pressure above 1.5 bar absolute. The formulation can thus also be used to reduce engine damage. The invention also provides a method of preparing a gasoline fuel, by mixing gasoline fuel components to achieve a laminar burning velocity $S_L$ for the resultant mixture which is equal to or below that of isooctane at a pressure of 1 bar, a temperature of 300 K and stoichiometric air/fuel mixture strength. It further provides a method for selecting a gasoline fuel for use in a turbocharged spark ignition engine, based on its laminar burning velocity $S_L$.

8 Claims, No Drawings

FUEL FORMULATIONS

FIELD OF THE INVENTION

This invention relates to gasoline fuel formulations, their preparation and their use.

BACKGROUND TO THE INVENTION

The current focus in the development of spark ignition (petrol) engines is to improve their efficiency. This can be done by down-sizing and/or turbocharging the engines. However, when this approach is taken, petrol engines have been observed to suffer from an abnormal combustion phenomenon known as pre-ignition, in which fuel combustion begins before the spark plug fires (see Manz, P-W et al, "Pre-ignition in highly turbo-charged engines. Analysis procedure and results", 8th International Symposium on Internal Combustion Diagnostics, Baden-Baden, 2008; Zadeh, A et al, "Diagnosing engine combustion using high-speed photography in conjunction with CFD", 8th International Symposium on Internal Combustion Diagnostics, Baden-Baden, 2008; Han, K-M et al, "3-D visualization of spark-ignition combustion: practical examples of flame propagation, abnormal combustion and controlled compression ignition", 8th International Symposium on Internal Combustion Diagnostics, Baden-Baden, 2008; and Gerringer, B et al, FISITA Paper F2006P392.

Pre-ignition significantly increases the pressure and temperature of the unburned gas ahead of the advancing flame (see Kalghatgi, G T et al, "The nature of 'superknock' and its origins in SI engines", I. Mech. E., onference on Internal combustion engines: Performance, Fuel Economy and Emissions, in London, Dec. 8-9, 2009; also Manz, P-W et al (above) and Zadeh, A et al (above)). This can lead to heavy knock (so-called "superknock"), another abnormal combustion phenomenon which could potentially damage the engine. It is therefore extremely important to reduce the probability of pre-ignition occurring in turbocharged spark ignition engines. Moreover as engines develop, with increasing levels of turbocharging in order to further increase efficiency, the problem of pre-ignition is likely to become more acute.

SUMMARY OF THE INVENTION

In one embodiment, a gasoline formulation is provided having a laminar burning velocity $S_L$ which is equal to or below that of isooctane at a pressure of 1 bar, a temperature of 300 K and stoichiometric air/fuel mixture strength.

In another embodiment, a method of operating an internal combustion engine, and/or a vehicle which is driven by an internal combustion engine comprising introducing into a combustion chamber of the engine a gasoline fuel formulation described above is provided.

In yet another embodiment, a method of selecting a gasoline fuel formulation for use in a spark ignition engine is provided comprising determining the laminar burning velocity $S_L$ of the formulation, and selecting the formulation for use in the engine if the value of $S_L$ is equal to or below that of isooctane at a pressure of 1 bar, a temperature of 300 K and stoichiometric air/fuel mixture strength.

DETAILED DESCRIPTION OF THE INVENTION

It has now been found that certain types of gasoline fuel formulation are less likely to give rise to pre-ignition in turbocharged engines. As a result, it can be possible to formulate gasoline fuels in such a manner as to overcome or at least mitigate the above described problems.

According to an embodiment of the present invention there is provided in a gasoline fuel formulation having a laminar burning velocity $S_L$ which is equal to or below that of isooctane at a pressure of 1 bar, a temperature of 300 K and stoichiometric air/fuel mixture strength.

The laminar burning velocity $S_L$ of a fuel component or fuel formulation may be measured using any suitable method, so long as the measured value is compared with a value for isooctane which has been obtained using the same method and under the same operating conditions. In other words, the laminar burning velocity of the fuel formulation $S_L^1$ measured using a method X under operating conditions Y must be below the laminar burning velocity of isooctane $S_L^2$ measured using the same method X under the same operating conditions Y. This is because different measurement methods can yield different values of $S_L$ even for the same fuel.

Examples of methods for measuring laminar burning velocities are described for example by Farrell et al in SAE paper 2004-01-2936; by Metghalchi & Keck in *Combustion and Flame* 48 (1982): 191-210; and by Bradley et al in *Combustion and Flame* 115 (1998): 126-144.

Investigations into the temperature and pressure effects on burning velocities have shown that following a change in temperature and pressure, the relative difference in flame speed and therefore also in laminar burning velocity, between two fuel components is maintained. Thus regardless of the conditions applied, if a fuel formulation or component burns faster than isooctane under one set of conditions, for example at one temperature and pressure, and then the temperature and/or pressure is increased, the fuel formulation or component will still burn faster than isooctane at the higher temperature and/or pressure conditions.

It is therefore reasonable to take a single condition point as indicative of the relative flame speed of a fuel formulation as compared to isooctane.

It has been found that fuel formulations having lower $S_L$ values, as defined above, appear to cause less if any pre-ignition in a turbocharged spark ignition engine. It is now believed (although we do not wish to be bound by this theory) that this effect is linked to the amount of local heat release which is able to occur within the fuel formulation. For pre-ignition to occur, some local heat release must take place in order to initiate the combustion which, in normal circumstances, is initiated by the spark. The mechanisms by which such local heat release occurs are not known but are believed to involve chemical kinetic and surface catalytic reactions centred around small particles, for example droplets of lubricating oil or particulate engine deposits. The rates of these chemical reactions are likely to be higher under higher pressures: thus, the likelihood of local heat release occurring increases if the pressure of the air/fuel mixture is increased by turbocharging.

The smaller the value of $S_L$ for a fuel, the larger the value of its minimum ignition energy $E_m$, which in turn means that combustion can be less easily initiated following local heat release. Thus, it is now believed that a fuel with a smaller $S_L$ will be less likely to suffer from pre-ignition problems under a given set of combustion conditions. Since $E_m$ is inversely proportional to both the temperature and the pressure of the fuel, it would be desirable to increase the $E_m$ of a fuel formulation which is to be used under the higher pressure conditions existing within turbocharged engines. In such engines, it can be particularly important to use fuels which have smaller $S_L$ values (and hence larger $E_m$ values) to reduce the probability of local heat release giving rise to premature combustion. The higher the air intake pressure of the engine (ie the higher the "boost" provided by the turbocharger), the greater the significance of the $E_m$ and $S_L$ values for the fuel.

It has not hitherto been deemed necessary to measure the laminar burning velocity of gasoline fuels, since the significance of the property—and its relevance to the risk of pre-ignition—has not been appreciated. Nor have fuel formulators deemed it necessary to formulate to a target $S_L$ value. Indeed for many purposes, in particular for improved combustion efficiency, it is believed preferable to formulate a gasoline fuel to have higher rather than lower burning speeds, and lower ignition energies. Current standard specifications for gasoline fuels, for example the European specification EN 228, do not constrain $S_L$ values. Thus the present invention, which requires a gasoline fuel to be formulated to have a lower $S_L$, represents an inventive step forward from the prior art on gasoline fuel formulations.

A fuel formulation according to the invention should be suitable for use in a spark ignition (petrol) internal combustion engine. It may in particular be suitable for use in a turbocharged spark ignition engine, more particularly a turbocharged spark ignition engine which operates, or may operate, or is intended to operate, with an inlet pressure above 1.5 bar absolute (which at an atmospheric pressure of 1 bar equates to a boost pressure of 0.5 bar).

In an embodiment of the invention, the formulation is suitable for use as an automotive fuel. In an embodiment, it complies with an applicable current standard gasoline fuel specification such as for example EN 228 in the European Union or ASTM D4814-08b in the USA. By way of example, the overall formulation may have a density from 0.720 to 0.775 kg/m$^3$ at 15° C. (ASTM D4052 or EN ISO 3675); a final boiling point (ASTM D86 or EN ISO 3405) of 210° C. or less; a research octane number (RON) (ASTM D2699 or EN 25164) of 85 or 90 or 95 or 98 or greater, for example from 90 to 105 or from 94 to 100; a motor octane number (MON) (ASTM D2700 or EN 25163) of 70 or 75 or 80 or 85 or greater, for example from 75 to 105 or from 84 to 95; an olefinic hydrocarbon content of from 0 to 20% v/v (ASTM D1319); and/or an oxygen content of from 0 to 5% w/w (EN 1601). It may have a vapour pressure at 37.8° C. (dry vapour pressure equivalent DVPE, which may be measured using EN 13016-1 or ASTM D4953-06) of 100 kPa or less, or of 90 or 80 or—in particular where the formulation is intended for use as a summer grade fuel—70 or 60 kPa or less. The formulation may have an E70 value (EN ISO 3405) of from 20 to 50% v/v (or for a summer grade gasoline from 20 to 48% v/v, or for a winter grade gasoline from 22 to 50% v/v). It may have an E100 value (EN ISO 3405) of from 46 to 71% v/v. Relevant specifications may however differ from country to country and from year to year, and may depend on the intended use of the formulation. Moreover a formulation according to the invention may contain fuel components with properties outside of these ranges, since the properties of an overall blend may differ, often significantly, from those of its individual constituents.

A gasoline fuel formulation according to the invention may suitably have an olefinic hydrocarbon content in the range of from 0 to 40% v/v (ASTM D1319), for example from 0 to 30% v/v, and may suitably have an aromatic hydrocarbon content in the range of from 0 to 70% v/v (ASTM D1319), for example from 10 to 60% v/v.

A gasoline fuel formulation according to the invention may comprise one or more gasoline fuel components, which may be conventional as known in the art. What is important is that the nature(s) and concentration(s) of those components be chosen such that the laminar burning velocity $S_L$ of the overall formulation is equal to or below that of isooctane at a pressure of 1 bar and a temperature of 300 K.

In an embodiment, the formulation comprises one or more gasoline base fuels. A gasoline base fuel is a liquid hydrocarbon distillate fuel component, or mixture of such components, containing hydrocarbons which boil in the range from 0 to 250° C. (ASTM D86 or EN ISO 3405) or from 20 or 25 to 200 or 230° C. The optimal boiling ranges and distillation curves for such base fuels will typically vary according to the conditions of their intended use, for example the climate, the season and any applicable local regulatory standards or consumer preferences.

The hydrocarbon fuel component(s) in the gasoline base fuel may be obtained from any suitable source. They may for example be derived from petroleum, coal tar, natural gas or wood, in particular petroleum. Alternatively they may be synthetic products such as from a Fischer-Tropsch synthesis. Conveniently they may be derived in any known manner from straight-run gasoline, synthetically-produced aromatic hydrocarbon mixtures, thermally or catalytically cracked hydrocarbons, hydrocracked petroleum fractions, catalytically reformed hydrocarbons or mixtures of these.

Typically, gasoline base fuels comprise components selected from one or more of the following groups: saturated hydrocarbons, olefinic hydrocarbons, aromatic hydrocarbons and oxygenated hydrocarbons. Conveniently, a gasoline base fuel may comprise a mixture of saturated hydrocarbons, olefinic hydrocarbons, aromatic hydrocarbons and, optionally, oxygenated hydrocarbons. Typically, the olefinic hydrocarbon content of a gasoline base fuel is in the range from 0 to 40% v/v (ASTM D1319); it may for instance be in the range from 0 to 30% v/v. Typically, the aromatic hydrocarbon content of a gasoline base fuel is from 0 to 70% v/v (ASTM D1319); it may for instance be from 10 to 60% v/v.

The benzene content of a gasoline base fuel is typically at most 10% v/v, or at most 5% v/v, or at most 1% v/v. Typically, the saturated hydrocarbon content of a gasoline base fuel is at least 40% v/v; it may for instance be from 40 to 80% v/v.

A gasoline base fuel used in the present invention suitably has a low or ultra low sulphur content, for instance at most 1000 ppmw (parts per million by weight) of sulphur, or no more than 500 ppmw, or no more than 100 ppmw, or no more than 50 or even 10 ppmw. It also suitably has a low total lead content, such as at most 0.005 g/l; in an embodiment it is lead free ("unleaded"), ie it has no lead compounds in it.

A gasoline base fuel will typically have a research octane number (RON) (ASTM D2699 or EN 25164) of 80 or greater, or of 85 or 90 or 93 or 94 or 95 or 98 or greater, for example from 80 to 110 or from 85 to 115 or from 90 to 105 or from 93 to 102 or from 94 to 100. It will typically have a motor octane number (MON) (ASTM D2700 or EN 25163) of 70 or greater, or of 75 or 80 or 84 or 85 or greater, for example from 70 to 110 or from 75 to 105 or from 84 to 95.

A gasoline base fuel will typically have an E70 value of 10% v/v or greater, or of 14 or 15 or 20 or 22% v/v or greater. Its E70 value might typically be up to 55% v/v, or up to 51 or 50 or 48% v/v. Its E70 value might for example be from 10 to 55% v/v, or from 14 to 51% v/v, or from 14 to 50% v/v, or from 20 to 50% v/v. In an embodiment, it has an E70 value of from 20 to 48% v/v. In an alternative embodiment, it has an E70 value of from 22 to 50% v/v.

A gasoline base fuel will typically have an E100 value of 35% v/v or greater, or of 40 or 45 or 46% v/v or greater. Its E100 value might typically be up to 75% v/v, or up to 72 or 71% v/v. Its E100 value might for example be from 35 to 75% v/v, or from 40 to 72% v/v, or from 40 to 71% v/v, or from 46 to 71% v/v.

The E70 value for a fuel is the volume percentage of the fuel which has been distilled at 70° C., whilst the E100 value is the volume percentage of the fuel which has been distilled at 100° C. Both E70 and E100 values can be measured using the standard test method EN ISO 3405.

The specific distillation curve, hydrocarbon composition, RON and MON of a gasoline base fuel are not however critical for the purposes of the present invention. What is important is its contribution to the laminar burning velocity of the overall fuel formulation.

A gasoline base fuel might typically have a density from 0.720 to 0.775 kg/m$^3$ at 15° C. (ASTM D4052 or EN ISO 3675). For use in a summer grade gasoline fuel, a base fuel might typically have a vapour pressure at 37.8° C. (DVPE) of from 45 to 70 kPa or from 45 to 60 kPa (EN 13016-1 or ASTM D4953-06). For use in a winter grade fuel it might typically have a DVPE of from 50 to 100 kPa, for example from 50 to 80 kPa or from 60 to 90 kPa or from 65 to 95 kPa or from 70 to 100 kPa.

A gasoline base fuel may be or include one or more biofuel components, which are derived—whether directly or indirectly—from biological sources. Such components may have boiling points within the normal gasoline boiling range. The base fuel may be or include one or more oxygenates, which may for example be selected from alcohols (for example C1 to C5 saturated or unsaturated alcohols, in particular C1 to C4 aliphatic alcohols such as butanol or more particularly ethanol); ethers (including cyclic ethers such as furans), in particular dialkyl ethers, more particularly (C1 to C3 alkyl) t-butyl ethers such as methyl t-butyl ether and ethyl t-butyl ether); esters; carboxylic acids and their derivatives; aldehydes; ketones; and mixtures thereof. In an embodiment, the formulation contains one or more oxygenates selected from alcohols, ethers, esters and mixtures thereof. In an embodiment, it contains one or more oxygenates selected from alcohols, ethers and mixtures thereof. Such oxygenates may be derived from biological sources.

In another embodiment, however, it may be preferred for the formulation not to contain a C1 to C4 aliphatic alcohol, in particular ethanol or butanol, more particularly ethanol. This is because alcohols such as ethanol can have relatively high $S_L$ values.

A base fuel may include one or more gasoline fuel additives, of the type which are well known in the art. It may be a reformulated gasoline base fuel, for example one which has been reformulated so as to accommodate the addition of an oxygenate such as ethanol.

Examples of suitable gasoline base fuels include those having an olefinic hydrocarbon content of from 0 to 20% v/v (ASTM D1319), and/or an oxygen content of from 0 to 5% w/w (EN 1601), and/or an aromatic hydrocarbon content of from 0 to 50% v/v (ASTM D1319), and/or a benzene content of at most 1% v/v. In an embodiment of the invention, the gasoline base fuel complies with the current European gasoline fuel standard EN 228. In an embodiment, it complies with the current US gasoline fuel standard ASTM D4814-08b.

It may be preferred for a formulation according to the invention to contain one or more slower burning gasoline base fuels and/or gasoline fuel components. In an embodiment, the formulation contains solely or predominantly (for example 90% v/v or more, or 95 or 98 or 99% v/v or more) slower burning gasoline fuel components.

In an embodiment, the laminar burning velocity $S_L$ of the overall fuel formulation is equal to, or approximately equal to, that of isooctane at a pressure of 1 bar, a temperature of 300 K and stoichiometric air/fuel mixture strength. It is to be understood that since laminar burning velocities are extremely difficult to measure with precision, a value for $S_L$ which is within 2% of, for example within 1% or 0.5% of, that of isooctane may be regarded as equal to that of isooctane.

In an embodiment, the laminar burning velocity $S_L$ of the overall fuel formulation is below that of isooctane at a pressure of 1 bar, a temperature of 300 K and stoichiometric air/fuel mixture strength. In an embodiment, $S_L$ is at least 5% lower, or at least 10% lower, or at least 15% lower, than that of isooctane at a pressure of 1 bar, a temperature of 300 K and stoichiometric air/fuel mixture strength.

A fuel formulation according to the invention may contain one or more standard fuel or refinery additives which are suitable for use in gasoline fuels. Many such additives are known and commercially available. They may be present in the base fuel, as described above, or may be added to the fuel formulation at any point during its preparation, including as a premix with one or more other components of the formulation.

In another embodiment of the present invention provides a method of operating an internal combustion engine, and/or a vehicle which is driven by an internal combustion engine, which method involves introducing into a combustion chamber of the engine a gasoline fuel formulation according to the first aspect of the invention. The engine is preferably a spark ignition engine, in particular a turbocharged spark ignition engine. It may operate, or be capable of operating, or be intended to operate, with an inlet pressure of greater than 1.5 bar absolute.

In another embodiment provides a system which includes an internal combustion engine and a source of a gasoline fuel formulation according to the first aspect. The engine may be of the type defined in connection with the second aspect of the invention. The system may be a vehicle. The source of the fuel formulation may be a fuel tank containing the formulation.

In another embodiment, the invention provides the use of a gasoline fuel formulation having a laminar burning velocity $S_L$ which is equal to or below that of isooctane at a pressure of 1 bar, a temperature of 300 K and stoichiometric air/fuel mixture strength, for the purpose of reducing the occurrence of pre-ignition in a spark ignition engine which is running or is intended to be run on the fuel formulation.

The engine may in particular be a turbocharged spark ignition engine. In an embodiment of the invention, it is a turbocharged spark ignition engine which operates, or may operate, or is intended to operate, with an inlet pressure above 1.5 bar absolute.

The invention embraces the use, in a gasoline fuel formulation, of a gasoline fuel component or mixture of gasoline fuel components (for example a gasoline base fuel of the type described above), wherein the fuel component or mixture has a laminar burning velocity $S_L$ which is equal to or below that of isooctane at a pressure of 1 bar, a temperature of 300 K and stoichiometric air/fuel mixture strength, for the purpose of reducing the occurrence of pre-ignition in a spark ignition engine which is running or is intended to be run on the fuel formulation. The fuel component or mixture may constitute a major proportion of the fuel formulation, by which is meant 80% v/v or greater, or 85 or 90 or 95% v/v or greater, or in cases 98 or 99 or 99.5% v/v or greater.

The level of occurrence of pre-ignition in a spark ignition engine may be assessed using any suitable method, for instance a method as described in the examples below. In general, such a method may involve running a spark ignition engine on the relevant gasoline fuel formulation, and monitoring changes in engine pressure during its combustion cycles, ie changes in pressure versus crank angle. A pre-ignition event will result in an increase in engine pressure before sparking: this may occur during some engine cycles but not others. Instead or in addition, changes in engine performance may be monitored, for example maximum attainable brake torque, engine speed, intake pressure and/or exhaust gas temperature. Instead or in addition, a suitably experienced driver may test-drive a vehicle which is driven by the spark ignition engine, to assess the effects of the fuel formulation on for example the degree of engine knock or other aspects of engine performance. Instead or in addition, levels of engine damage due to pre-ignition, for example due to the associated engine knock, may be monitored over a period of time during which the spark ignition engine is running on the relevant gasoline fuel formulation.

A reduction in the occurrence of pre-ignition may be a reduction in the rate at which pre-ignition events occur within the engine, and/or in the severity of the pre-ignition events which occur (for example, the degree pressure change which they cause). It may be manifested by a reduction in one or more of the effects which pre-ignition can have on engine performance, for example impairment of brake torque or inhibition of engine speed. It may be manifested by a reduction in the amount or severity of engine knock, in particular by a reduction in, or elimination of, "superknock". Thus the present invention may be used for the purpose of reducing one or more such side effects of pre-ignition.

Since pre-ignition, particularly if it occurs frequently, can cause significant engine damage, the present invention may also be used for the purpose of reducing engine damage and/or for the purpose of increasing engine longevity. Thus, the invention provides a gasoline fuel formulation having a laminar burning velocity $S_L$ which is equal to or below that of isooctane at a pressure of 1 bar, a temperature of 300 K and stoichiometric air/fuel mixture strength that may be used, for reducing damage to a spark ignition engine which is running or is intended to be run on the fuel formulation, and/or for increasing the engine's longevity.

The invention may be used to achieve any degree of reduction in the occurrence of pre-ignition in the engine, including reduction to zero (ie eliminating pre-ignition). It may be used to achieve any degree of reduction in a side effect of pre-ignition, for example engine damage. It may be used for the purpose of achieving a desired target level of occurrence or side effect.

In the present context, "achieving" a desired target property also embraces—and in an embodiment involves—improving on the relevant target. Thus, for example, the invention may be used to reduce the occurrence of pre-ignition to below a desired target level.

In the context of the present invention, "use" of a gasoline fuel formulation may involve introducing the formulation into a fuel-consuming system such as a spark ignition internal combustion engine, and/or running such a system on the fuel formulation.

Use of a gasoline fuel component (or mixture thereof) in a gasoline fuel formulation means incorporating the component or mixture into the formulation, typically as a blend (ie a physical mixture) with one or more other fuel components and optionally one or more gasoline fuel additives. The component or mixture will conveniently be incorporated before the formulation is introduced into an engine or other system which is to be run on the formulation. Instead or in addition the use of the component or mixture may involve running a fuel-consuming system, such as an internal combustion engine, on a gasoline fuel formulation containing the component or mixture, typically by introducing the formulation into a combustion chamber of an engine.

Whilst not critical to the present invention, the gasoline fuel formulation of the present invention may conveniently additionally include one or more fuel additive. Non-limiting examples of suitable types of fuel additives that can be included in the gasoline fuel formulation include anti oxidants, corrosion inhibitors, detergents, dehazers, antiknock additives, metal deactivators, valve seat recession protectant compounds, dyes, friction modifiers, carrier fluids, diluents and markers. Examples of suitable such additives are described generally in U.S. Pat. No. 5,855,629.

Conveniently, the fuel additives can be blended with one or more diluents or carrier fluids, to form an additive concentrate, the additive concentrate can then be admixed with the fuel formulation directly or incorporated into one of the gasoline fuel components such as a gasoline base fuel.

The (active matter) concentration of any additives present in the fuel formulation of the present invention is preferably up to 1 percent by weight, more preferably in the range from 5 to 1000 ppmw, advantageously in the range of from 75 to 300 ppmw, such as from 95 to 150 ppmw.

The component or mixture may itself be supplied as part of a composition which is suitable for and/or intended for use as a fuel additive, in which case the component or mixture may be included in such a composition for the purpose of influencing its effects on the tendency of a gasoline fuel formulation to cause pre-ignition.

In another embodiment of the invention provides a method of preparing a gasoline fuel formulation, which method involves mixing together two or more gasoline fuel components and/or fuel additives so as to achieve a laminar burning velocity $S_L$ for the resultant mixture which is equal to or below that of isooctane at a pressure of 1 bar, a temperature of 300 K and stoichiometric air/fuel mixture strength. This may be done for the purpose of reducing the risk of pre-ignition in a spark ignition engine which is subsequently run or intended to be run on the fuel formulation.

The method may involve determining the laminar burning velocity $S_L$ of the components of the formulation and combining them in suitable concentration ratios in order to achieve the desired laminar burning velocity for the formulation as a whole. It may involve determining the laminar burning velocity $S_L$ of the formulation before, during and/or after its preparation. Laminar burning velocities for individual fuel components may be determined either by referring to available literature (for example the SAE paper by Farrell et al referred to above), or by measurement, for example using a method described in Farrell et al.

Laminar burning velocities for mixtures of fuel components may be determined by referring to available literature or by measurement, or may be calculated using conventional linear-by-volume blending rules based on the laminar burning velocities and the concentration ratios of the individual components in the mixture: thus, for example, in a mixture of n fuel components, $$S_l = \sum_{i=D}^{n} vf_i S_{l_i}$$

where $S_1$ is the laminar burning velocity of the mixture, $S_{li}$ is the laminar burning velocity of component i, and $vf_i$ is the volume fraction of component i.

Thus where the fuel formulation is composed of a number of fuel components, the overall laminar burning velocity can either be measured by one of the techniques mentioned above or be calculated by multiplying the known or measured laminar burning velocity of each component by the volume fraction of the component, dividing each value given by 100, and then summing the resulting values.

The method of the invention may be used to produce at least 1,000 liters of the fuel formulation, or at least 5,000 or 10,000 or 20,000 or 50,000 liters.

In another embodiment of the invention provides a method for selecting a gasoline fuel formulation for use in a spark ignition engine (in particular a turbocharged spark ignition engine, more particularly a turbocharged engine which is operated, or capable of being operated, or intended to be operated, at an inlet pressure of greater than 1.5 bar absolute), which method involves determining the laminar burning velocity $S_L$ of the formulation, and selecting the formulation for use in the engine if the value of $S_L$ is equal to or below that of isooctane at a pressure of 1 bar, a temperature of 300 K and stoichiometric air/fuel mixture strength. Again, the value for $S_L$ may be determined by referring to available literature, by measurement and/or by calculation (for instance based on the laminar burning velocities and concentration ratios of individual components of the formulation).

A fuel formulation according to the invention, or a formulation prepared or used according to the invention, may be marketed with an indication that it provides an improvement due to the present invention. The improvement may for example be that the formulation reduces the occurrence of pre-ignition in a spark ignition engine running on the formulation, as described above. The improvement may be that the formulation improves the performance of such an engine, and/or reduces the risk of engine damage, in one or more of the ways described above. The improvement may be attributed, in such an indication, at least partly to the lower laminar burning velocity of the formulation (ie to the fact that its $S_L$ is equal to or lower than that of isooctane at a pressure of 1 bar, a temperature of 300 K and stoichiometric air/fuel mixture strength). The invention may involve assessing one or more effects of the formulation during its use in a (typically turbocharged) spark ignition engine.

Throughout the description and claims of this specification, the words "comprise" and "contain" and variations of the words, for example "comprising" and "comprises", mean "including but not limited to", and do not exclude other moieties, additives, components, integers or steps. Moreover the singular encompasses the plural unless the context otherwise requires: in particular, where the indefinite article is used, the specification is to be understood as contemplating plurality as well as singularity, unless the context requires otherwise.

Preferred features of each aspect of the invention may be as described in connection with any of the other aspects. Other features of the invention will become apparent from the following examples. Generally speaking the invention extends to any novel one, or any novel combination, of the features disclosed in this specification (including any accompanying claims and drawings). Thus features, integers, characteristics, compounds, chemical moieties or groups described in conjunction with a particular aspect, embodiment or example of the invention are to be understood to be applicable to any other aspect, embodiment or example described herein unless incompatible therewith. Moreover unless stated otherwise, any feature disclosed herein may be replaced by an alternative feature serving the same or a similar purpose.

Where upper and lower limits are quoted for a property, for example for the concentration of a fuel component, then a range of values defined by a combination of any of the upper limits with any of the lower limits may also be implied.

The present invention will now be further described with reference to the following non-limiting example.

Example

Two gasoline fuel formulations were tested in a modern 4-cylinder direct-injection turbocharged spark ignition engine, a 2.0 L I4 DI-Turbo GM Ecotec™ retrofitted with a cooled external EGR system. The test engine had been modified with cylinder pressure probes to allow the gathering of real-time combustion data.

The engine was run at full throttle and 2000 rpm, with the inlet pressure above 1.5 bar absolute, using 0% external EGR. Further details of the test engine are listed in Table 1 below.

TABLE 1

| | |
|---|---|
| Bore | 86 mm |
| Stroke | 86 mm |
| Compression ratio | 9.4:1 |
| Number of valves per cylinder | 4 |
| Cam timing (Dual-VVT) | production Cal |
| Oil temperature | 100° C. |
| Coolant-out temperature | 90° C. |
| Injection type | Direct (wall-guided) |
| Chamber type | Pent-roof |
| Piston type | Asymmetrical bowl-in-crown |
| Other | Custom external EGR (cooled) |
| Dynamometer | McClure ™ 250 kW |
| Emissions bench | Horiba Mexa ™-7100DEGR |
| Fuel conditioning cabinet | Pierburg ™:-P11701 |
| Fuel conditioning meter | Pierburg ™:-PLU103B |
| Cylinder pressure sensors | Kistler ™ type 6125 |
| Cylinder pressure acquisition | Redline ™ AdaptCAS |

The test formulations, F1 and F2, had the compositions shown in Tables 2 and 3 respectively. F1 was a petroleum-derived, EN 228-compliant gasoline fuel prepared from refinery streams having an aromatics content of 29.07% v/v.

TABLE 2

(Formulation F1)

| Fuel component | Concentration (% by liquid volume) |
|---|---|
| Heavy reformate | 8.82 |
| LCC naphtha tops | 7.64 |
| Raffinate | 9.9 |
| Alkylate | 24.55 |
| Isomerate | 28.91 |
| Isopentane | 1.23 |
| Xylene | 16.95 |
| Toluene | 1.5 |
| Isooctane (95%) | 0.5 |

TABLE 3

(Formulation F2)

| Fuel component | Concentration (% by liquid volume) |
|---|---|
| Ethylbenzene | 34.50 |
| Cyclohexane | 25 |
| Isooctane | 8.75 |
| Cyclopentane | 6.25 |
| Pent-1-ene | 18 |
| n-pentane | 7 |
| Benzene | 0.50 |

The laminar burning velocity $S_L$ of formulation F1 was determined to be approximately 1.004 times (ie for practical purposes equal to) that of isooctane at a pressure of 1 bar, a temperature of 300 K and stoichiometric air/fuel mixture strength. The laminar burning velocity $S_L$ of formulation F2 was determined to be approximately 1.166 times (ie approximately 16.6% higher than) that of isooctane at a pressure of 1 bar, a temperature of 300 K and stoichiometric air/fuel mixture strength. Other properties of the two formulations are summarised in Table 4 below.

TABLE 4

| Parameter | Test method | Units | F1 | F2 |
|---|---|---|---|---|
| Research octane number (RON) | ASTM D2699 | — | 95.2 | 96.4 |
| Research octane number (RON)-corrected | | — | 95 | 96.2 |
| Motor octane number (MON) | ASTM D2700 | — | 86.9 | 82.8 |
| Motor octane number (MON) - corrected | | — | 86.7 | 82.6 |
| Density @ 15° C. | IP 365 | g $cm^{-3}$ | 0.7292 | 0.7685 |
| Distillation | IP 123 | | | |
| IBP | | ° C. | 34.1 | 38.6 |
| 10% rec | | ° C. | 53.7 | 57.5 |
| 20% rec | | ° C. | 60.9 | 63.7 |
| 30% rec | | ° C. | 68.9 | 71.3 |
| 40% rec | | ° C. | 78.7 | 81.1 |
| 50% rec | | ° C. | 90.7 | 92.9 |
| 60% rec | | ° C. | 103.9 | 104.1 |
| 70% rec | | ° C. | 115.9 | 116.6 |
| 80% rec | | ° C. | 127.4 | 130.3 |
| 90% rec | | ° C. | 139.7 | 133.7 |
| 95% rec | | ° C. | 147.1 | 13.9 |
| FBP | | ° C. | 170.8 | 136.7 |
| Residue | | % vol | 1 | 0.7 |
| Recovery | | % vol | 98.2 | 98.2 |
| Loss | | % vol | 0.8 | 1.1 |
| E70 | | % vol | 31.1 | 28.4 |
| E100 | | % vol | 57.1 | 56.2 |
| E120 | | % vol | 73.8 | 72.1 |
| RVP | IP 394/ ASTM D5191 | kPa | 56.1 | 47.9 |
| GC | LTP/26 | | | |
| C | | — | 6.60 | 6.44 |
| H | | — | 12.51 | 11.15 |
| O | | — | 0 | 0 |
| Calculated H/C ratio | | — | 1.9 | 1.731366 |
| Calculated O/C ratio | | — | 0 | 0 |
| CWF | | — | 0.862475 | 0.873132 |
| Gross heat comb. | IP12 | cal (IT)/g | 10645 | 10265 |
| Net heat com | IP12 | cal (IT)/g | 9950 | 9655 |
| Carbon | ASTM D5291 | % w/w | 86.3 | 86.8 |
| Hydrogen | ASTM D5291 | % w/w | 13.7 | 12 |
| Carbon:hydrogen ratio | ASTM D5291 | | 1 to 1.9 | 1 to 1.7 |
| Oxygen content | MT/MCR/21 | % w/w | <0.04 | <0.04 |

The tests were conducted as follows. Upon starting with each fuel formulation, the engine was warmed to attain 90° C. coolant out and >95° C. oil temperatures. These temperatures were monitored daily (under load and motoring conditions) to ensure consistency. After warming, the engine was operated at lambda=0.95, wide open throttle and ~90% of a specific torque target. Boost was then increased to reach the desired torque, followed by leaning the fuelling to achieve lambda=1 operation. The spark timing was then set such that the value of peak-to-peak knock was 1.8±0.3 bar. Once this condition had been achieved, boost, fuelling, EGR rate and spark were calibrated to allow for the safest engine operation while still well into mild knock.

Other limits were:

- the coefficient of variation of indicated mean effective pressure (COV of IMEP) did not exceed 3%; and
- the exhaust gas temperature, EGT, entering the turbocharger (the turbine air inlet temperature) did not exceed 930° C.

Each test-point was allowed to stabilise for approximately 30 seconds before data was collected. The data recorded included cylinder by cylinder pressure vs. crank angle data acquisition of 300 cycles and summaries of the last 30 cycles (running average filtered). A wide range of parameters was measured, including in-cylinder pressure, spark timing, IMEP, BSFC (brake specific fuel consumption), burn angles, exhaust gas temperature, EGR rate and inlet manifold pressure.

Approximately 17 liters of fuel were required to fully purge the test cell system when changing fuels. Fuel density was measured on-line via continuous sampling. It was found that a further 5 liters of fuel were required to run through the engine before the measured density matched the provided data values.

The engine parameters (boost, spark timing, fuelling) were consistently and systematically varied to achieve the maximum brake torque for each fuel, whilst under mild knocking conditions and at lambda=1. These "best attainable" operating conditions are listed in Table 5, for both fuel formulations.

TABLE 5

| Operating condition | F1 | F2 |
|---|---|---|
| Engine speed (rpm) | 2005 | 2002 |
| Brake torque (Nm) | 362 | 326 |

TABLE 5-continued

| Operating condition | F1 | F2 |
|---|---|---|
| Gauge intake pressure (kPa) | 105 | 85 |
| Exhaust gas temperature (° C.) | 929 | 905 |
| Spark timing (CAATDC) | −0.770 | −1.770 |
| BSFC (g/kWh) | 246 | 239 |
| COV (%) | 1.68 | 1.64 |

It can be seen from Table 5 that formulation F1 ($S_L$ approximately equal to that of isooctane) showed "normal" engine behaviour, with its optimum conditions limited by traditional knock. Pre-ignition was not observed using this formulation. By extrapolation, a formulation with a laminar burning velocity lower than that of isooctane would be expected to be even less susceptible to pre-ignition than F1.

However, using formulation F2 ($S_L$ higher than isooctane), engine operation was severely limited by pre-ignition, resulting in a considerably lower maximum torque than when the test engine was running on formulation F1. Pre-ignition was evident from plots of pressure versus crank angle for the tests conducted using formulation F2.

Thus a gasoline fuel formulation according to the invention can be used to reduce pre-ignition, and hence to improve performance, in a turbocharged spark ignition engine. This in turn can allow fuel formulators to prepare gasoline fuels which are better suited for use in turbocharged petrol engines, in particular engines which are operated, or intended to be operated, at higher intake pressures.

We claim:

1. A gasoline fuel formulation having a laminar burning velocity $S_L$ which is equal to or below that of isooctane at a pressure of 1 bar, a temperature of 300 K and stoichiometric air/fuel mixture strength.

2. The gasoline fuel formulation of claim 1 which has an aromatic hydrocarbon content in the range of from 0 to 70% v/v.

3. The gasoline fuel formulation of claim 2 which includes one or more gasoline fuel additives.

4. A method of operating an internal combustion engine, and/or a vehicle which is driven by an internal combustion engine comprising introducing into a combustion chamber of the engine a gasoline fuel formulation of claim 1.

5. A method of operating an internal combustion engine, and/or a vehicle which is driven by an internal combustion engine comprising introducing into a combustion chamber of the engine a gasoline fuel formulation of claim 2.

6. A system comprising an internal combustion engine, and a source of a gasoline fuel formulation of claim 2.

7. The gasoline formulation of claim 1, wherein the spark ignition engine is a turbocharged spark ignition engine.

8. The gasoline formulation of claim 1 further comprising at most 10% v/v benzene.

* * * * *